United States Patent [19]

Gignac et al.

[11] Patent Number: 5,074,010

[45] Date of Patent: Dec. 24, 1991

[54] VEHICLE DOOR CHECK MECHANISM

[75] Inventors: Robert J. Gignac, Belleville; Paul J. Dunbar, Brighton, both of Mich.

[73] Assignee: Thunderline Corporation, Belleville, Mich.

[21] Appl. No.: 409,391

[22] Filed: Sep. 18, 1989

[51] Int. Cl.[5] ..... E05D 11/10

[52] U.S. Cl. ..... 16/334; 16/335; 16/86 A; 292/275

[58] Field of Search ..... 16/334, 86 A, 86 B, 16/86 C, 335; 292/73, 75, 77, 275, DIG. 41, DIG. 56

[56] References Cited

U.S. PATENT DOCUMENTS

| | | |
|---|---|---|
| 2,039,960 | 5/1936 | Jacobs . |
| 2,074,398 | 3/1937 | Jacobs . |
| 2,140,958 | 12/1938 | Jacobs . |
| 2,523,088 | 9/1950 | Beyer . |
| 2,882,548 | 4/1959 | Roethel . |
| 2,915,779 | 12/1959 | Allen . |
| 2,979,355 | 4/1961 | Brown . |
| 2,980,945 | 4/1961 | Hollar . |
| 3,065,497 | 11/1962 | Faber . |
| 3,224,033 | 12/1965 | Fannan et al. . |
| 3,224,034 | 12/1965 | Fannan et al. . |
| 3,230,576 | 1/1966 | Sauer . |
| 3,369,833 | 2/1968 | Schaldenbrand . |
| 3,550,185 | 12/1970 | Marchione . |
| 3,710,417 | 1/1973 | Berman et al. . |
| 3,905,064 | 9/1975 | Brockhaus . |
| 3,911,529 | 10/1975 | Pringle . |
| 3,969,789 | 7/1976 | Wize . |
| 4,266,321 | 5/1981 | Pelchat et al. . |
| 4,532,675 | 8/1985 | Salazar . |
| 4,720,895 | 1/1988 | Peebles . |
| 4,800,624 | 1/1989 | Whitefoot et al. ..... 16/86 A |

FOREIGN PATENT DOCUMENTS

| | | |
|---|---|---|
| 165693 | 12/1985 | European Pat. Off. . |
| 1915750 | 10/1970 | Fed. Rep. of Germany . |
| 2123536 | 12/1972 | Fed. Rep. of Germany . |
| 2406906 | 8/1975 | Fed. Rep. of Germany . |
| 2284740 | 4/1976 | France . |
| 2592913 | 7/1987 | France . |

*Primary Examiner*—Richard K. Seidel
*Assistant Examiner*—Carmine Cuda
*Attorney, Agent, or Firm*—Kinzer, Plyer, Dorn, McEachran & Jambor

[57] ABSTRACT

A door check mechanism for regulating pivotal movement of a vehicle door between a closed position and one or more open positions, which mechanism is sometimes incorporated in a hinge, includes an elongated track member having a track surface with at least one detent receptacle in that track surface; a detent roller engages the track surface in rolling pressure contact at least part of the time whenever the door moves between its open and closed positions. Either the roller or the track has a resilient elastomer core, preferably an elastomer material (e.g., a silicone polymer) that retains its elastic properties over a temperature range that extends much higher than any temperature usually endurable by humans; the core is covered by a hard, relatively nonelastic but flexible sheath. The engaging portions of the roller and track surfaces are preferably dissimilar materials, usually a metal and a resin.

16 Claims, 5 Drawing Sheets

(DOOR CLOSED)

(DOOR OPEN)

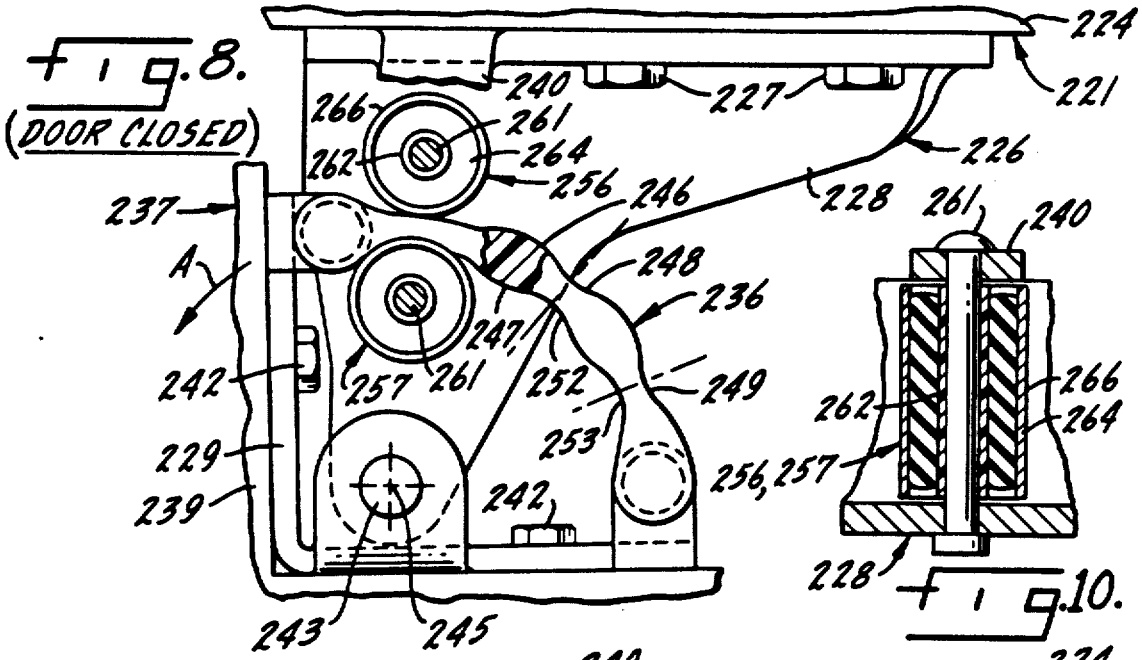
Fig. 8.
(DOOR CLOSED)
Fig. 10.
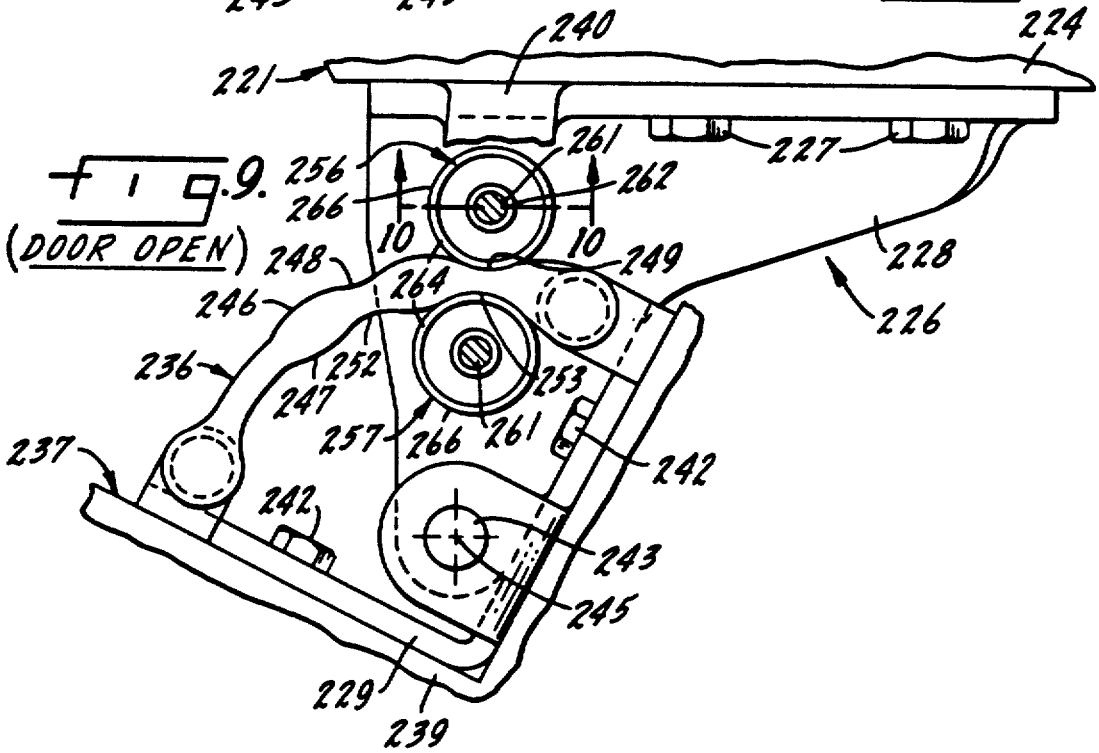
Fig. 9.
(DOOR OPEN)

(DOOR CLOSED)

(DOOR OPEN)

(DOOR CLOSED)

(DOOR PARTIALLY OPEN)

(DOOR CLOSED)

VEHICLE DOOR CHECK MECHANISM

BACKGROUND OF THE INVENTION

On automobiles, recreational vehicles, vans, small trucks, and virtually all other vehicles, a door check mechanism for each vehicle door is usually considered a necessity. In many applications, the door check mechanism provides two open positions, one at which the door is partially open and the other at which the door is fully open, though even the full open position is usually appreciably less than ninety degrees. In some applications the door check mechanism for a vehicle door provides only one open retention position.

Door check mechanisms of this sort are quite common and have been used for many years. However, they are far from uniform in construction or in application. In many vehicles the manufacturer provides a check mechanism that is separate from the door hinges. In this arrangement, particularly in small cars, each door is supported upon two simple hinges that do not establish any retained or detented open positions for the door. In other instances, particularly in larger automobiles, the manufacturer may prefer hinges that incorporate check mechanisms in the hinge structures. Thus, in a typical large car construction, each door is hung from two hinges, and one of those hinges includes a door check mechanism establishing two retention or detented positions for holding the door open.

Door check mechanisms, as applied to vehicle doors, have exhibited some substantial difficulties. Thus, the door check mechanisms used in automobiles and similar applications, whether separate from or combined with hinges, have frequently required lubrication, without which they tend to squeak and to make other undesirable noises. Some of these door check devices only produce noises when opened to full detented open position or beyond that position. Many of these door check mechanisms afford inadequate operating life; they do not last for the full life of the vehicle. In any of these door checks, corrosion may be a substantial problem. In at least some door check mechanisms, processing of the vehicle body after installation of the doors, particularly in the curing of external finishes, may require temperatures well beyond the tolerance range of materials used in the door check mechanisms. Thus, it is not uncommon for a vehicle body to be subjected, at least for a brief interval, to temperatures up to near 400° F. after the door installations are completed. This may result in appreciable damage to a door check mechanism, whether incorporated in or separate from a door hinge, and may even require replacement of the door check.

SUMMARY OF THE INVENTION

It is a primary object of the invention, therefore, to provide a new and improved door check mechanism for regulating movements of a vehicle door, which mechanism provides positive retention of the vehicle door in one or in either of two defined open positions without interferring with opening and closing movements of the doors, yet exhibits long life and is essentially unaffected by very high temperatures and by quite low temperatures.

A further object of the invention is to provide a new and improved door check mechanism for a vehicle door that affords an extended operating life without requiring lubrication, yet is simple and relatively inexpensive in construction and in operation.

Accordingly, the invention relates to a door check mechanism for regulating movement of a vehicle door, pivotally mounted on a first support element comprising part of a vehicle frame, between a closed position and an open position that is displaced from the closed positino by a predetermined angle, the vehicle door including a second support element. The door check mechanism comprises a track member, including an elongated track surface having a roller detent receptacle therein, a detent roller member, and mounting means for mounting the track member on one of the support elements and for mounting the detent roller member on the other of the support elements with the detent roller member aligned with the track surface. The detent roller member has a resilient, locally distortable construction including a resilient elastomer core supporting a hard external sheath, the external sheath affording the surface of the detent roller member which engages the track member. The elastomer core of the detent member is formed of an elastomer material that retains its resiliency and elasticity even though subjected to elevated temperatures of the order of 400° F. The track surface and the external surface of the detent roller are formed of dissimilar materials. The mounting means and the resilient distortable construction of the detent roller member conjointly maintain the detent roller member in pressure rolling engagement with the track surface during at least a portion of the movement of the door between its closed and open positions. The alignment of the roller member and the track surface cause the detent roller member to engage in the detent receptacle when the door is pivoted to its open position so that the detent roller member and the track member releasably maintain the door in its open position.

BRIEF DESCRIPTION OF THE DRAWINGS

FIG. 8 is a partially sectional plan view of another embodiment of the invention, with the check mechanism incorporated in a vehicle door hinge, the door being closed;

FIG. 9 is a view like FIG. 8 but with the door fully open;

FIG. 10 is a detail sectional view taken approximately along line 10—10 in FIG. 9;

DESCRIPTION OF THE PREFERRED EMBODIMENTS

Figure 1:
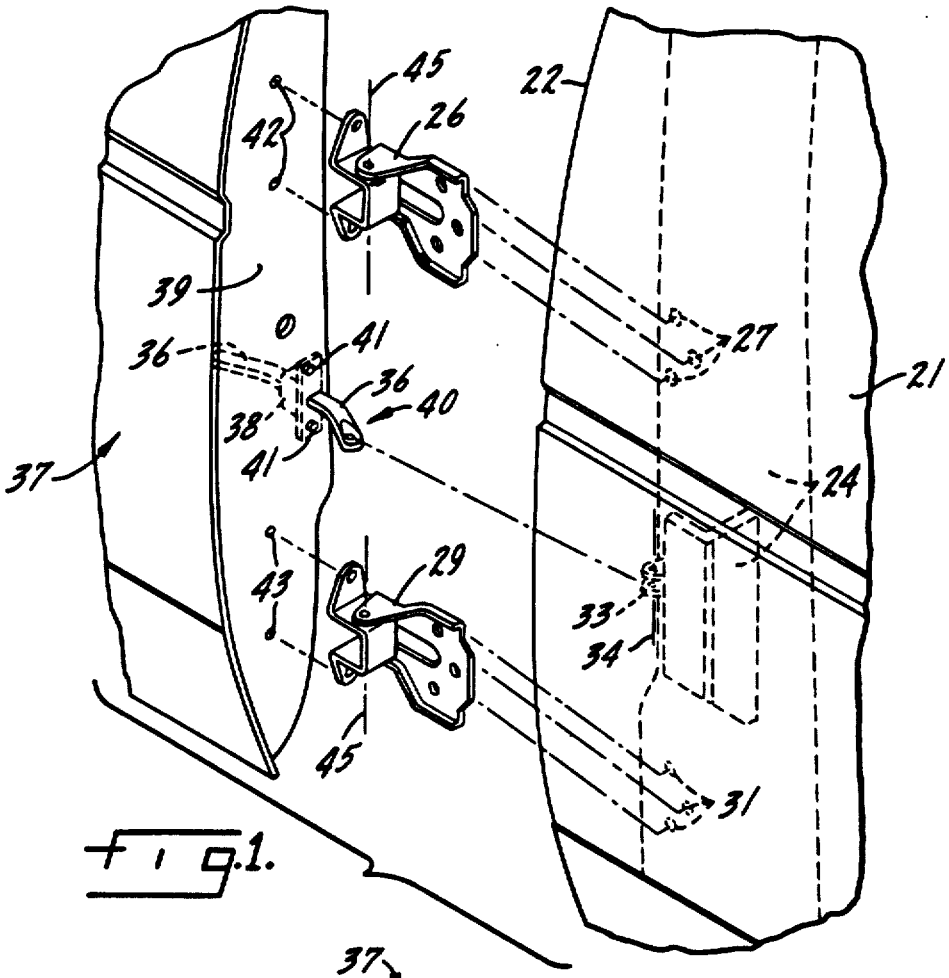
FIG. 1 is a partially exploded perspective view of a vehicle door mounting, employed to describe and illustrate use of a door check mechanism.

FIG. 1 affords a partially exploded perspective view of a portion of the side of a vehicle, including a part of a door opening. At the right-hand side of FIG. 1 a portion of the right front side body of the vehicle is shown. This could be an automobile, a small or large truck, or virtually any other kind of vehicle. The edge of the door opening, along the left-hand vertical side of body member 21, is identified by reference numeral 22. Closely adjacent to it there is a vertical frame member 24, a part of the vehicle frame.

The door arrangement shown in FIG. 1 includes an upper hinge 26 that includes appropriate provisions for mounting on the vertical frame member 24 at three mounting locations 27. Similarly, there is a second, lower hinge 29 that is fastened to the vertical frame member 24 at plural locations such as the locations 31. In addition, a clevis 33 is shown mounted on the vertical frame member 24. Clevis 33 has a vertical axis 34. The clevis is a part of a door check mechanism 40 comprising one embodiment of the present invention, described more fully in connection with FIGS. 2-5. The clevis affords a pivotal connection for an elongated track member 36 that projects outwardly from frame member 24 and clevis 33 toward a door 37. Track member 36 extends through a guide device 38 that is mounted on door 37.

Door 37 includes a vertical support member 39 that is an integral part of the door. Guide device 38 is mounted on support member 39 by a plurality of appropriate fasteners 41. Clevis 33, track member 36, and guide device 38 all are part of check mechanism 40. Of course, upper hinge 26 is mounted on door 37, preferably as indicated at points 42 on support member 39. Similarly, lower hinge 29 is secured to the vertical support member 39 of door 37 at appropriate locations 43. The two hinges 26 and 29, in an accurately installed door, should have a common pivotal axis 45, the axis for pivotal movement of the door.

Figures 3, 4, 5, 6, 7:
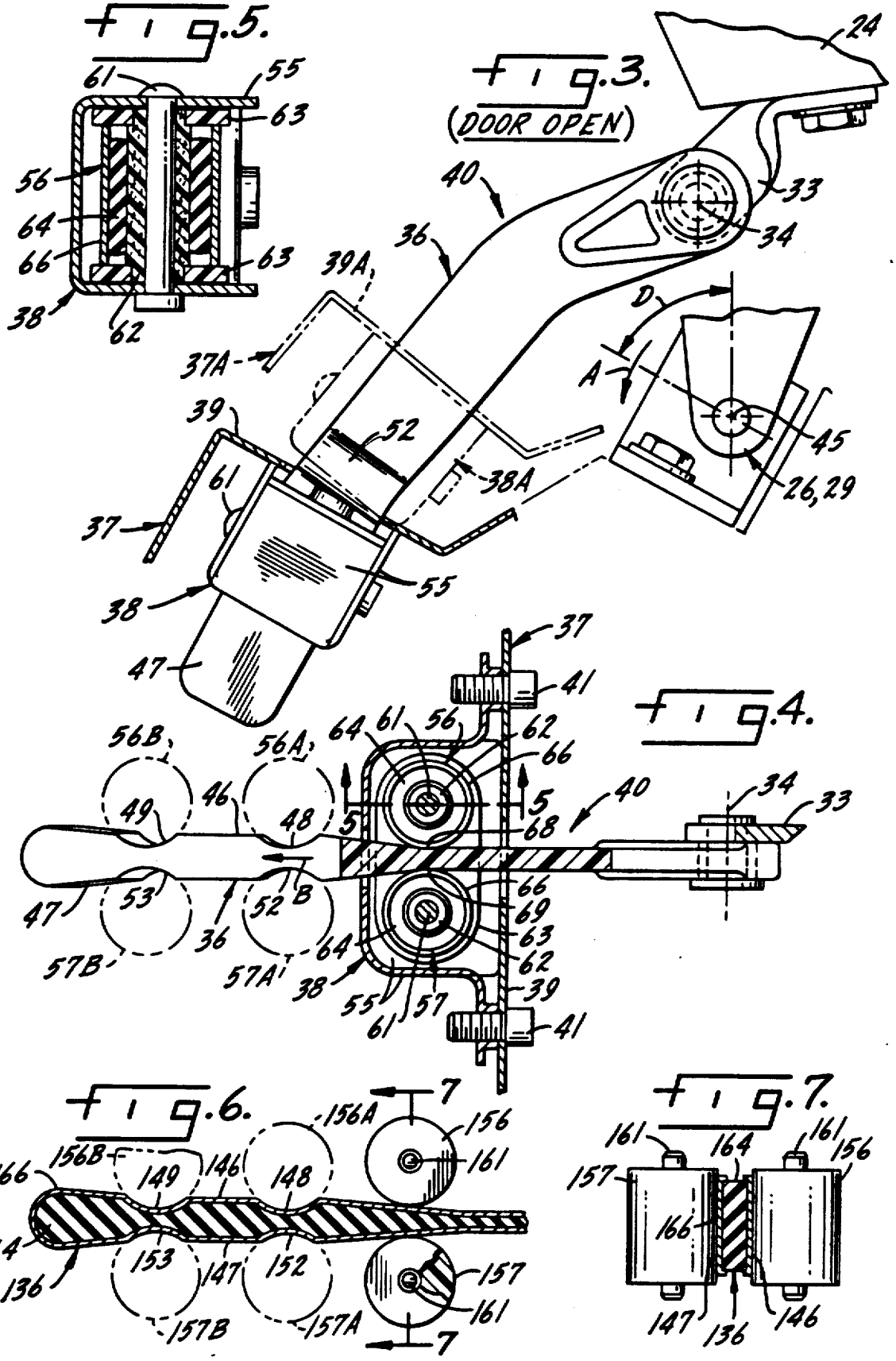
FIG. 3 is a partially sectional plan view like FIG. 2 but with the door fully open.
FIG. 4 is a detail view, partly in cross section, taken approximately as indicated by line 4—4 in FIG. 2.
FIG. 5 is a detail sectional view taken approximately as indicated by line 5—5 in FIG. 4.
FIG. 6 is a detail view, partly in cross section like FIG. 4, but showing a modification of the door check mechanism of FIGS. 2-5.
FIG. 7 is a detail sectional view taken approximately as indicated by line 7—7 in FIG. 6.

In the preferred form of door check mechanism 40 that is shown in FIGS. 2-5, track member 36 has two opposed track surfaces 46 and 47, both surfaces appearing in FIG. 4. As best seen in FIG. 4, there are two depressions or detent receptacles 48 and 49 in the one track surface 46, and these are matched by two complementary detent receptacles 52 and 53 in the other track surface 47. The number and distribution of the detent receptacles in track surfaces 46 and 47 is determined by the number of retention positions desired for door 37 when opened away from body 21 (FIG. 1) and also by the number of detent rollers used in the mechanism.

Figure 2:
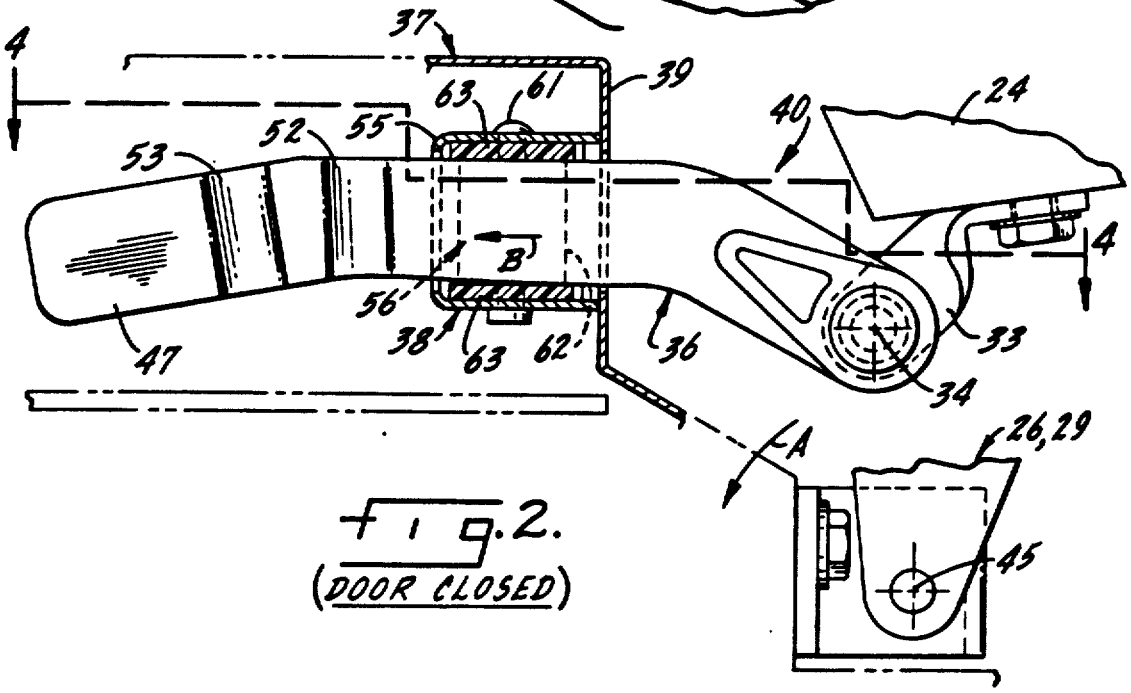
FIG. 2 is a partially sectional plan view of a vehicle door check mechanism constructed in accordance with one embodiment of the invention, with the door closed.

The construction of guide device 38 for door check mechanism 40 may best be understood from FIGS. 2, 4 and 5. Guide device 38 includes an external housing 55 that may be formed of sheet metal and that is mounted upon door support element 39 by bolts or other fasteners 41; see FIG. 4. The configuration of housing 55 is not particularly critical. The housing does provide a firm mounting for two detent rollers 56 and 57. Roller 56 engages track surface 46 of track member 36 and roller 57 engages the other track surface 47 of member 36. Roller 56, as shown in detail in FIG. 5, may comprise a central shaft 61 on which a bushing member 62 is journalled. Bushing 62 is preferably a precision molded element of relatively hard plastic and may, for example, be formed of heat stabilized, 33% glass-fiber-filled 6-6 nylon or of an aramid fiber reinforced, lubricant impregnated polyfluoroethylene terephthalate (PTFE) resin. Two molded resin end guides 63 engage the opposite ends of bushing 62 to hold rollers 56 and 57 in alignment.

In roller 56, FIG. 5, a cylindrical core 64 is disposed in encompassing relation to the central portion of bushing member 62. Core 64 is formed of a resilient elastomer material that is capable of retaining its resiliency over a broad range of temperatures, temperatures far beyond those likely to be encountered in any vehicle usage and, indeed, substantially beyond any that might be tolerated by human beings. Thus, the elastomer used for core should retain its elastic, resilient properties at temperatures well below 0° F. and at temperatures exceeding 400° F., the latter requirement being based on temperatures used in curing vehicle finishes. Silicone polymer rubbers (polydimethylsiloxane) are preferred for elastomer core 64. Core 64 is adhesively secured or otherwise bonded to bushing 62.

Around the outside of core 64 there is an external sheath 66 that spans the distance between guides 63. In the construction illustrated in FIG. 5 sheath 66 is formed of a high grade steel or other relatively thin metal, preferably one that is resistant to corrosion and susceptible of affording long life under substantially adverse conditions. For example, sheath 66 may be formed of ASTM A-519, 28 max carbon seamless steel tubing, preferably with a phosphate zinc organic (black) plating or zinc dichromate finish. Core 64 should be maintained under limited compression between sheath 66 and bushing 62. Typically, the compression should be such as to cause no more than thirty percent deflection; excessive compression of core 64 may materially reduce operating life for roller 56.

The use of metal for sheath 66 of roller 56 (and in roller 57) is predicated upon the assumption that track member 36 and its surfaces 46 and 47 are formed of a hard, durable resin material such as nylon, so that when the two engage each other, as seen in FIGS. 2-4, the engagement will be that of two quite dissimilar materials. Of course, if track member 36 is formed of steel or other metal, then the external sheath 66 on each of the rollers 56,57 (FIG. 5) is preferably a relatively hard precision molded resin such as heat stabilized glass-fiber-filled 6-6 nylon or aramid-fiber-filled PTFE. Only the one roller 56 has been described in detail, particularly in connection with FIG. 5; it should be understood that the other roller 57 (FIG. 4) employs the same construction.

In explaining the operation of vehicle door check mechanism 40, it is most convenient to start from the closed position of door 37, as illustrated in FIGS. 2 and 4. Conveniently, the two detent rollers 56 and 57 are disposed in shallow detent recesses or receptacles 68 and 69 in the track surfaces 46 and 47 of track member 36 (FIG. 4) though this is not essential; for the closed position of the door, the detent rollers could be spaced from the track surfaces.

To open door 37, the door latch (not shown) is released and the door is pivoted toward an open position with respect to car body 21 and particularly its frame member 24. The direction of this movement is counterclockwise about hinge axis 45, viewed from above, as indicated by the arrow A in FIG. 2. This pivotal movement of the door drives guide device 38 along track member 36, in the direction generally indicated by the arrows B in FIGS. 2 and 4, and compels track member 36 to pivot, again in a counterclockwise direction, about axis 34 of clevis 33. This movement continues, as the door proceeds in its pivotal opening movement, until the two detent rollers 56 and 57 come into alignment with the first pair of roller detent receptacles 48 and 52 in track surfaces 46 and 47 of member 36. At this point, the detent rollers, which have been driven apart by the thickness of the track member that they are traversing, drop into the two detent receptacles, seating there as indicated generally by the phantom outlines 56A and 57A in FIG. 4. If this position 37A is as far as the vehicle user wants to open door 37, rollers 56 and 57 remain engaged in receptacles 48 and 52 and the door is held firmly in a partially open position; the door support member 39 is at position 39A. In a typical automotive vehicle, this might be an opening angle of about 30° to 40° for the door. In general, the position for guide device 38 on track member 36, for this initial open position of the door, is indicated by the phantom outline 38A in FIG. 3.

Additional impetus can be applied to door 37 to swing it further open, as to the full open position shown in solid lines in FIG. 3. To this end, the door is pivoted further in the clockwise direction of arrow A and the rollers 56 and 57 ride along track surfaces 46 and 47 of member 36 into engagement with the two outer detent roller receptacles 49 and 53, reaching the position shown in FIG. 3. For this full open door position, with the detent rollers in the positions 56B and 57B, FIG. 4, the total pivotal movement of door 37, angle D, FIG. 3, may be about 60°. For the full open door position, as in the intermediate open position defined by detent receptacles 48 and 52, the vehicle door is held firmly in the desired open position, allowing egress and ingress of people, objects, and whatever from and into the vehicle.

To close door 37, of course, it is pivoted back toward body 21 and fixed frame member 24 (FIG. 1), reversing the previously described movements. That is, the door is driven back clockwise in a direction opposite to arrow A (FIG. 2), through angle D (FIG. 3) so that guide device 38 rides back along track member 36 in a direction opposite to arrows B (FIGS. 2 and 4) and the track member itself is again pivoted, in a clockwise direction, from the position of FIG. 3 back toward that of FIG. 2. On the return motion, if desired, door 37 can again be stopped and held at the intermediate position defined by detent roller receptacles 48 and 52, FIG. 4. On the other hand, if it is desired to close the door completely, it is pivoted back to the original position shown in FIG. 2 with the detent rollers engaged in their door-closed positions in receptacles 68 and 69, as shown in FIG. 4.

FIGS. 6 and 7 illustrate a modification of the door check mechanism of FIGS. 1-5. In this modification, the elongated track member 36 is replaced by a similarly shaped elongated track member 136 having two track surfaces 146 and 147. Track member 136 has a resilient, locally distortable construction including a central core 164 of a resilient elastomer material that retains its resilience over a wide thermal range. That thermal range, for example, may be from −30° F. to +400° F. The thermal range over which core 164 retains its readily distortable but highly resilient functional characteristic should, in any event, be well beyond the temperatures likely to be encountered in vehicle usage, normal or abnormal, and also beyond the tolerance ranges of human beings. The upper temperature limit should take account of vehicle processing occurring after the door check is mounted in the vehicle.

The track surfaces 146 and 147 of member 136 are formed by a continuous external "skin" 166 of sheet metal that holds core 164 under limited compression. Surface 147 is formed with two detent roller depressions or receptacles 152 and 153. Surface 146 of member 136 is shaped to afford two similar detent roller receptacles 148 and 149. Track surfaces 146 and 147 are engageable by two detent rollers 156 and 157; these detent rollers, as shown in FIGS. 6 and 7, need not engage the track surfaces when the door is closed. However, rollers 156 and 157 each engage one of the track surfaces in pressure rolling engagement during at least a part, preferably a major part, of the movement of the rollers from their closed door positions, shown in solid lines in FIGS. 5 and 6, to their door partially open positions 156A, 157A or their door full open positions 156B, 157B. The detent rollers 156 and 157 are preferably solid, molded of a hard, relatively non-resilient plastic such as a glass-fiber-filled heat stabilized nylon, and are mounted on metal shafts 161. The purpose, as before, is to assure that detent rollers 156,157 and the track surfaces 146,147 that the rollers engage are quite dissimilar materials, avoiding any tendency toward "freeze-up" in operation.

Functionally, the structural modification of FIGS. 6 and 7 does not change the previously described door check mechanism 40. The door can be swung to two distinct open positions and will be held firmly in either by the detent rollers and their track receptacles. In each version of the door closer, the resilient cores or core (64 and 164) are distorted during door movement, but the amount of distortion entailed does not add an excessive loading to the effort required for door movement. The force required to open or to close the door can be varied to meet design preferences by varying the modulus of elasticity for core 64 or core 164, or by varying the level of compression to which either core is subject. Little or no lubrication is required, in part due to the distortable nature of the detent rollers (FIGS. 2-5) or the track member (FIGS. 6,7) and to the use of completely different engaging surfaces on the roller and track members. Permanent lubrication, as with the use of lubricant-impregnated roller shafts or bearing members may be employed, but may be unnecessary in at least some instances.

FIGS. 8 and 9 illustrate a vehicle door hinge 226 that incorporates a door check mechanism comprising another embodiment of the invention. FIG. 10 affords a detail sectional view of a detent roller construction used in that mechanism.

In FIGS. 8 and 9 the body of a vehicle is generally indicated by reference numeral 221; more particularly, the part of the vehicle body shown is a vertical support element 224 that may be considered a part of the vehicle frame. A first hinge plate 228 is affixed to support element 224 by bolts or other suitable fasteners 227. A second, L-shaped hinge plate 229 is included in hinge 226 and is mounted on a door support element 239 by a plurality of bolts or other suitable fasteners 242. Support element 239 is a part of a vehicle door, generally indicated at 237. A hinge pin 243 affords a pivotal connection between hinge plates 228 and 229; the pivotal axis is indicated at 245.

An elongated, arcuate track member 236 is mounted on the L-shaped hinge plate 229; thus, hinge plate 229 effectively serves as a means for mounting track member 236 on the support element 239 comprising a part of door 237. In hinge 226, track member 236 is molded of a hard, relatively non-resilient plastic such as a glass-fiber-filled, heat stabilized nylon, or an aramid-fiber-filled PFTE resin. One track surface 246 of member 236 has two detent roller receptacles or depressions 248 and 249. The other track surface 247 of member 236 has two similar detent roller receptacles 252 and 253 aligned with receptacles 248 and 249, respectively.

Hinge 226, FIGS. 8 and 9, further comprises two detent roller shafts 261 that are affixed to and project vertically upwardly from hinge plate 228; the top of each shaft 261 is secured to a projection 240 that may be an integral part of hinge plate 228. Thus, detent roller shafts 261 are effectively mounted, through hinge plate 228, projection 240, and fasteners 227, onto support element 224. Two detent rollers 256 and 257 are included in hinge 226, each mounted on one of the shafts 261. A preferred construction for detent rollers 256 and 257 is shown in FIG. 10; it includes a plastic central bushing 262 journalled on shaft 261. Each bushing 262 is encompassed by and bonded to a resilient, locally distortable elastomer core 264. Core 264, in turn, is enclosed in and held under limited compression by a metal sheath or shell 266. Thin, flexible corrosion resistant steel tubing is preferred for shell 266.

Starting from the door closed position of FIG. 8, and assuming the door retainer latch (not shown) has been released, door 237 is pivoted counterclockwise about hinge axis 245, in the direction of arrow A, toward one of two open door positions. Detent roller shafts 261 are positioned to maintain rollers 256 and 257 in pressure rolling engagement with track surfaces 246 and 247 during most, if not all, of this movement. The pressure is increased as rollers 256 and 257 approach the first pair of detent roller receptacles 248 and 252, but this increase in pressure does not materially impede the door-opening movement and is effectively compensated by resilient distortion of the detent rollers, particularly their cores 264. The force requirements may be varied by adjustment of the compression of cores 264 or by selection of the modulus of elasticity of the core material. Door 237 may be stopped and firmly held in a first open position with rollers 256 and 257 in receptacles 248 and 252, respectively; for hinge 226, this first open position has door 237 open about 35°. Door 237 may be moved further on, in the direction of arrow A, until the detent rollers are in receptacles 249 and 253. For this full open condition, door 237 is actually open at an angle of about 60°; see FIG. 9.

Closing door 237 merely entails reverse, clockwise pivotal movement, from either the full door open position of FIG. 9 or the intermediate open position to the closed position of FIG. 8. The door check mechanism comprising track member 236 and detent rollers 256 and 257, in hinge 226, is as simple and automatic in its operation as the previously described separate door check mechanism 40 of FIGS. 2-5.

The door check mechanism in hinge 226 is subject to the same range of modifications as the previously described embodiment. Thus, the elongated track member 236, with its detent roller receptacles, may be formed of metal, or at least with metal track surfaces; if it is, the external shell 266 on each detent roller (FIG. 10) should preferably be of non-metallic construction (e.g., a heat stabilized nylon) to maximize life of hinge 226 and its door check. Conversely, track member 236 may be modified to use a resilient, locally deformable construction with an elastomer core, as in FIGS. 6 and 7. If so, the detent rollers are also usually changed, to a rigid, relatively non-resilient construction. Lubrication requirements are minimized; however, roller shafts 261 may utilize a lubricant-impregnated material.

Figure 11:
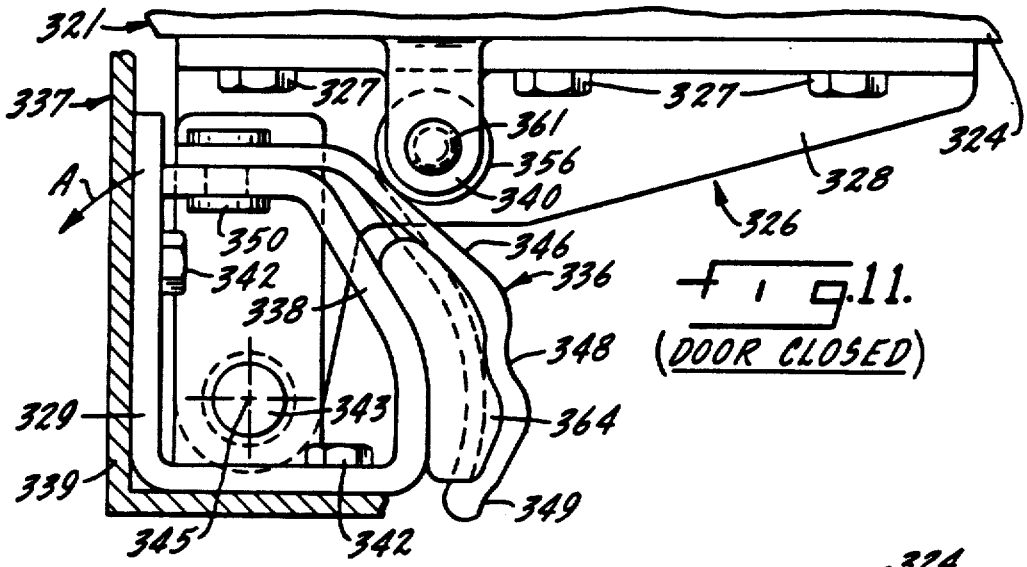
FIGS. 11 and 12 are partially sectional plan views of another embodiment of the invention, in closed and fully open conditions, respectively, for the vehicle door.
Figure 12:
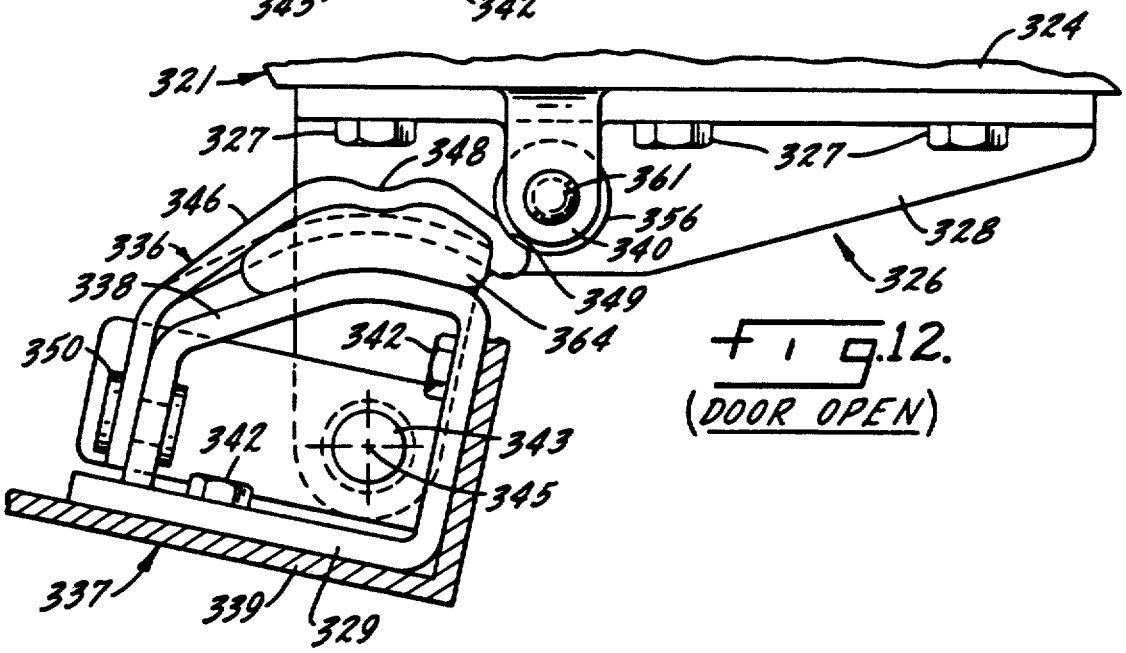

FIGS. 11 and 12 illustrate the closed and full open positions, respectively, for a vehicle door hinge 326 that incorporates another embodiment of the invention. Hinge 326 includes a first hinge plate 328 mounted, by bolts or other appropriate feasteners 327, on a first vertical support member 324 that is a part of a vehicle body 321. A hard, relatively non-resilient, detent roller 356 is journalled on a shaft 361 that is affixed to and projects vertically between hinge plate 328 and a projection 340 that may be an integral part of the hinge plate.

The second hinge plate 329 of hinge 326 is mounted, by bolts or other suitable fasteners 342, on a second support element 339 that is a part of a vehicle door 337. The second hinge "plate" 329 is actually of closed, box-like construction, including a wall 338 facing generally toward detent roller 356. A hinge pin 343 having a vertical axis 345 is used to afford a pivotal interconnection between hinge plates 328 and 329.

In hinge 326 wall 338 of hinge member 329 is a part of an elongated composite track member 336. Track member 336 further comprises a relatively stiff, thick outer track surface member 346 that has one end mounted on wall 338 by suitable means such as one or more rivets 350. Track surface member 346 includes two detent roller receptacles or depressions 348 and 349. The track surface member may be molded or formed of metal or of plastic; preferably, detent roller 356 is formed of metal if track surface member 346 is plastic, and vice versa. A core 364 formed of a resilient elastomer material is interposed between elements 338 and 346 of track member 336. As in previously described embodiments, the elastomer used in core 364 should retain its resilience and elasticity over a broad temperature range, substantially beyond any temperature that would or could be encountered by hinge 326 in any anticipated use. For example, a silicone polymer rubber may be used for elastomer core 364.

Operation of the door check mechanism in hinge 326 is essentially the same as for previously described embodiments. Door 337 is pivoted counterclockwise, to open, about axis 345; see arrow A. The door can be opened part way, to lodge detent roller 356 in receptacle 348, and the detent roller/track mechanism will hold the door firmly in this intermediate alignment. Further counterclockwise rotation of door 337 opens it completely, engaging detent roller in the outer receptacle 349. This is the full open condition shown in FIG. 12. Reverse rotation, clockwise, closes the door.

In hinge 326, FIGS. 11 and 12, it is the resilient, elastomeric distortion of core 364 that allows the door check mechanism to function effectively, holding the door firmly at either of two open positions without adding materially to the effort required to open or close the door. Wear is minimized, as is the need for lubrication, by the hinge/check mechanism; a long, trouble-free operating life is afforded by this and all other embodiments of the invention. Of course, selection of the elastomer for the cores (64, 164, 264, 364) is important;

elastomers that age rapidly or that change in response to marginal thermal conditions will not realize the important advantages of the invention.

Figure 13:
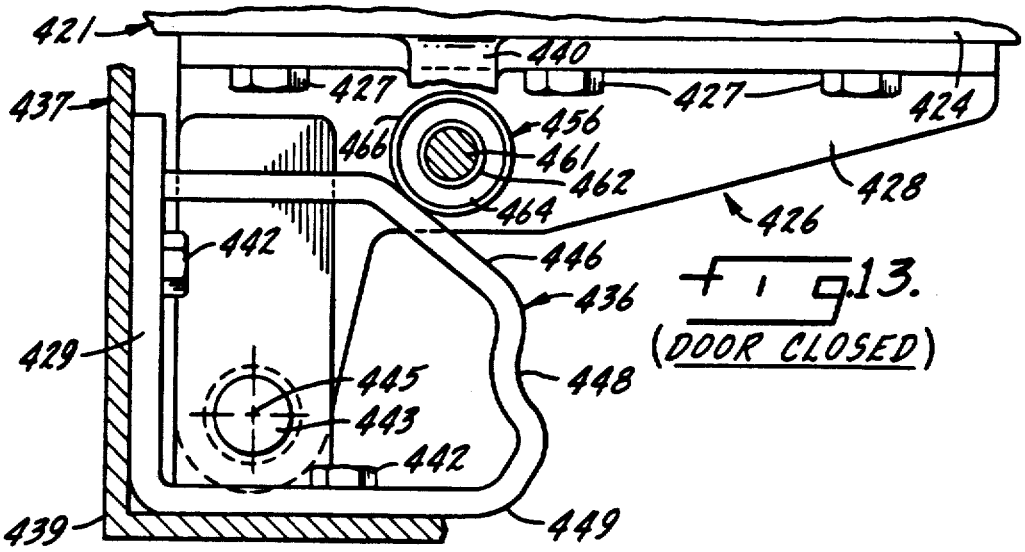
FIGS. 13 and 14 are partially sectional plan views of yet another embodiment of the invention, in closed and in partially open conditions, respectively, for the vehicle door.
Figure 14:
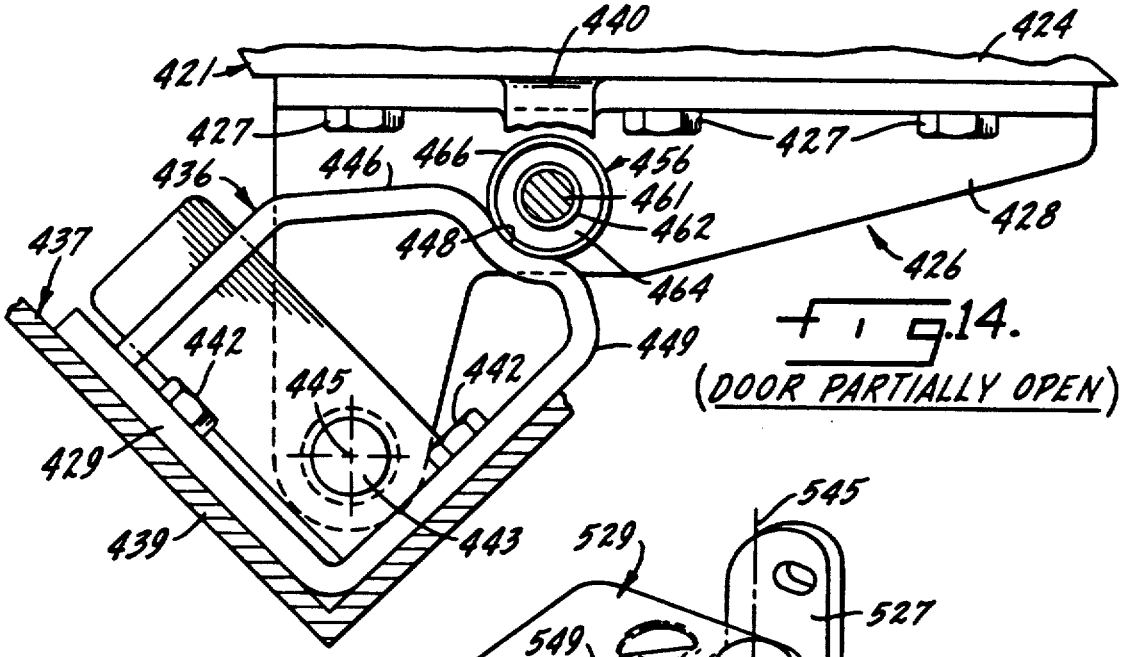

FIGS. 13 and 14 afford plan views illustrating a hinge 426 incorporating a door check mechanism comprising a further embodiment of the invention. In FIG. 13 the door is closed; in FIG. 14 it is at a partially open position. Hinge 426 includes a first hinge plate 428 shown mounted on a vertical support element 424 of a vehicle body 421 by appropriate means such as the fasteners 427. Hinge plate 428 could also be mounted on a support element in a vehicle door; a similar reversal could be made in other embodiments of the invention.

A detent roller 456 is mounted on a roller shaft 461 affixed to and projecting upwardly from hinge plate 426. The upper end of shaft 461 is secured to a member 440 that may be an integral part of hinge plate 428. Detent roller 456 is of resilient, locally distortable construction; it includes an inner bushing or bearing member 462, journalled on shaft 461, that is encompassed by and bonded to a resilient elastomer core 464. Core 464, in turn, is enclosed, under limited compression, in a flexible but essentially non-elastic sheath or shell 466 but is not bonded to the sheath. Thus, it is seen that roller 456 has a construction similar to previously described rollers 56 and 256; the same structural requirements apply.

In hinge 426 the second hinge "plate" 429 is of closed, box-like construction, including a relatively elongated track member 436 having a track surface 446 facing detent roller 456. Track surface 446 includes a detent roller receptacle 448; the downwardly curved end of surface 446 may be considered a second such "receptacle" 449. If member 436 is metal, roller sheath 466 should be plastic, and vice versa. Hinge plate 429 is mounted on a support element 439 of vehicle door 437 by bolts or other appropriate fastener 442. A pivot pin 443 connects hinge plates 426 and 429 for relative pivotal movement about a vertical axis 445.

Operation of hinge 426 and its door check mechanism, FIGS. 13 and 14, is essentially the same as described for FIGS. 11 and 12, and hence needs no repetition. The principal difference is that in hinge 426 pressure distortion, during opening and closing movements of the door, occurs in detent roller 456, due to the presence of elastomer core 464, whereas in hinge 326 it is the track member core 364 that is compressed during door movements.

Figure 15:
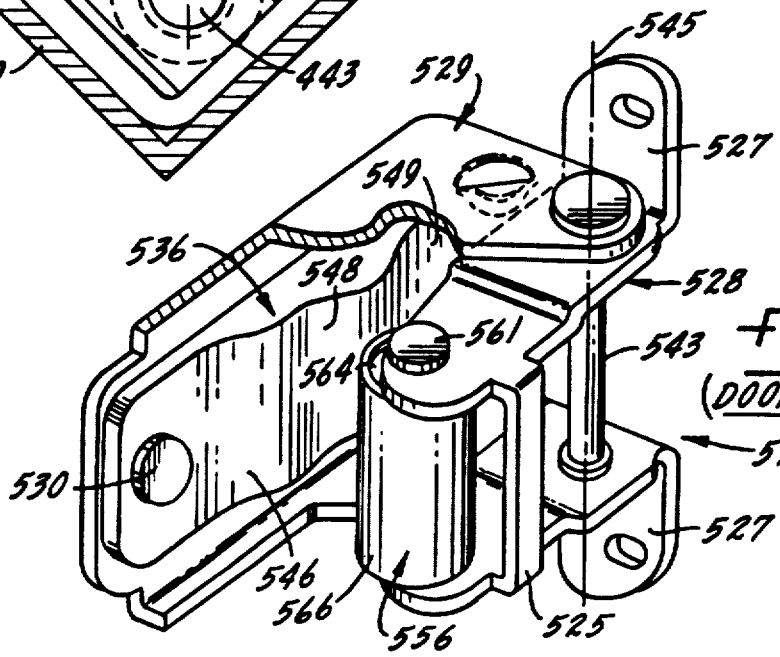
FIG. 15 is a perspective view of a further embodiment of the invention, in door closed condition.

FIG. 15 provides a perspective illustration of a vehicle door hinge 526 incorporating a door check mechanism in accordance with another embodiment of the invention. In hinge 526 one hinge member 528 comprises two complementary mounting elements 527 joined by a connection member 525. A hinge pin 543 extends between the upper and lower mounting elements 527 and affords a pivotal hinge connection to a second hinge plate or member 529. The hinge axis is indicated at 545.

A detent roller 556 is journalled on a detent shaft 561 that extends between the two elements 527 of hinge member 528. Roller 556 is of a composite construction like the rollers shown in FIGS. 5, 10, and 13; it includes a hard but flexible external shell 566 that encompasses and compresses a resilient, locally deformable elastomer core 564. Core 564 should be bonded to a bushing (not shown) journalled on shaft 561. Roller 556 engages a molded or cast track member 536 mounted on hinge member 529 by appropriate means such as rivet 530. The track surface 546 of track member 536, the surface engaged by detent roller 556, has detent roller receptacles 548 and 549 defining desired door-open positions for hinge 526. As in previous embodiments, if track surface 546 of track member 536 is metal, then sheath 566 on roller 556 is preferably plastic, and vice versa.

In any of the various embodiments of the invention described above, the door check mechanism should afford excellent performance characteristics over the full vehicle life. These door check mechanisms provide quiet operation over the full range of door movement, require little or no lubrication and have a minimum of moving parts; they are light in weight and adaptable to use with bolts, butt welding, or virtually any other mounting arrangement. Corrosion is effectively avoided; adjustment of operational force requirements is readily achieved.

We claim:

1. A door check mechanism for regulating movement of a vehicle door, pivotally mounted on a first support element comprising part of a vehicle frame, between a closed position and an open position that is displaced from the closed position by a predetermined angle, the vehicle door including a second support element, the door check mechanism comprising:

a track member, including an elongated track surface having a roller detent receptacle therein;

a detent roller member;

mounting means for mounting the track member on one of the support elements and for mounting the detent roller member on the other of the support elements with the detent roller member aligned with the track surface;

the detent roller member having a resilient, locally distortable construction including a hard, substantially non-elastic internal bushing encompassed by a resilient elastomer core supporting a hard external sheath, the external sheath affording the surface of the detent roller member which engages the track member, the elastomer core being maintained in compression between the internal bushing and the external sheath;

the elastomer core of the detent roller member being formed of an elastomer material that retains its resiliency and elasticity even though subjected to elevated temperatures of the order of 400° F.;

the track surface and the external surface of the detent roller that engages the track surface being formed of dissimilar materials;

the mounting means and the resilient distortable construction of the detent roller member conjointly maintaining the detent roller member in pressure rolling engagement with the track surface during at least a portion of the movement of the door between its closed and open positions; and the alignment of the detent roller member and the track surface causing the detent roller member to engage in the detent receptacle when the door is pivoted to its open position so that the detent roller member and the track member releasably maintain the door in its open position.

2. A door check mechanism according to claim 1 in which the elastomer core is bonded to the internal bushing.

3. A door check mechanism according to claim 2 in which the elastomer core is maintained in compression between the internal bushing and the external sheath and the elastomer core is bonded to the internal bushing.

4. A door check mechanism according to claim 3 in which the elastomer core is a silicone polymer rubber capable of withstanding temperatures of at least 400° F.

5. A door check mechanism according to claim 4 in which the internal bushing is molded of an aramid fiber reinforced PFTE resin.

6. A door check mechanism according to claim 4 in which the external sheath is formed of a glass fiber reinforced, heat stabilized nylon resin.

7. A door check mechanism according to claim 7 in which the track surface is a glass-fiber-reinforced, heat stabilized nylon resin, and the external surface of the detent roller is a steel tube.

8. A door check mechanism according to claim 7 in which the external surface of the detent roller is afforded by a seamless mild steel tube with an organic zinc phosphate plating.

9. A door check mechanism according to claim 1 in which the track member is steel and the external surface of the detent roller is a heat stabilized resin.

10. A door check mechanism for regulating movement of a vehicle door, pivotally mounted on a first support element comprising part of a vehicle frame, between a closed position and an open position that is displaced from the closed position by a predetermined angle, the vehicle door including a second support element, the door check mechanism comprising:

a track member, including an elongated track surface having a roller detent receptacle therein;

a detent roller member;

mounting means for mounting the track member on one of the support elements and for mounting the detent roller member on the other of the support elements with the detent roller member aligned with the track surface;

the track member having a resilient, locally distortable construction including a resilient elastomer core supporting a hard external sheath, the external sheath affording a track surface on the track member which engages the detent roller member;

the track surface and the external surface of the detent roller that engages the track surface being formed of dissimilar materials;

the mounting means and the resilient distortable construction of said track member conjointly maintaining the detent roller member in pressure rolling engagement with the track surface during at least a portion of the movement of the door between its closed and open positions; and the alignment of the detent roller member and the track surface causing the detent roller member to engage in the detent receptacle when the door is pivoted to its open position so that the detent roller member and the track member releasably maintain the door in its open position.

11. A door check mechanism according to claim 10 in which the elastomer core is maintained in compression within the track surface sheath.

12. A door check mechanism according to claim 11 in which the elastomer core is a silicone polymer rubber capable of withstanding temperatures of at least 400° F.

13. A door check mechanism according to claim 12 in which the track surface sheath is a fiber reinforced heat stabilized resin and the detent roller has an external surface of plated steel.

14. A door check mechanism according to claim 12 in which the track surface sheath is steel and the detent roller has an external surface of heat-stabilized resin.

15. A door check mechanism according to claim 14 in which the detent roller is molded of glass-fiber-reinforced heat stabilized nylon resin.

16. A door check mechanism for regulating movement of a vehicle door, pivotally mounted on a first support element comprising part of a vehicle frame, between a closed position and an open position that is displaced from the closed position by a predetermined angle, the vehicle door including a second support element, the door check mechanism comprising:

a track member, including an elongated track surface having a roller detent receptacle therein;

a detent roller member;

mounting means for mounting the track member on one of the support elements and for mounting the detent roller member on the other of the support elements with the detent roller member aligned with the track surface;

the detent roller member having a resilient, locally distortable construction including a resilient elastomer core encompassing a hard, substantially nonelastic internal bushing and supporting a hard external sheath, the external sheath affording the surface of the detent roller member which engages the member;

the mounting means and the resilient distortable construction of said one member conjointly maintaining the detent roller member in pressure rolling engagement with the track surface during at least a portion of the movement of the door between its closed and open positions; and the alignment of the detent roller member and the track surface causing the detent roller member to engage in the detent receptacle when the door is pivoted to its open position so that the detent roller member and the track member releasably maintain the door in its open position.

at least one of the detent and track members having a resilient, locally distortable elastomer core supporting a hard external sheath;

* * * * *